US005443246A

United States Patent [19]

Peterson

[11] Patent Number: 5,443,246

[45] Date of Patent: Aug. 22, 1995

[54] CLAMP JAW EXTENDER FOR BAR CLAMPS

[76] Inventor: Donovan J. Peterson, 2835 N. Watts, Portland, Oreg. 97217

[21] Appl. No.: 159,123

[22] Filed: Nov. 30, 1993

[51] Int. Cl.[6] ..... B25B 1/24

[52] U.S. Cl. ..... 269/283; 269/166

[58] Field of Search ..... 269/166–171.5, 269/203, 208, 283, 285, 147–149

[56] References Cited

U.S. PATENT DOCUMENTS

| | | | |
|---|---|---|---|
| 3,499,206 | 3/1970 | Quernheim | 269/283 |
| 3,767,183 | 10/1973 | Van Gelder | 269/283 |
| 4,306,710 | 12/1981 | Vosper | 269/283 |
| 4,381,105 | 4/1983 | Goff et al. | 269/171 |
| 4,437,654 | 3/1984 | Chlappetti | 269/283 |

FOREIGN PATENT DOCUMENTS

| | | | |
|---|---|---|---|
| 67859 | 10/1948 | Denmark | 269/166 |

*Primary Examiner*—Robert C. Watson

*Attorney, Agent, or Firm*—Phillips, Moore, Lempio & Finley

[57] ABSTRACT

A clamp jaw extender is adapted to be releasably attached to each jaw of a standard bar clamp to substantially increase the clamp depth thereof. The extender comprises a clamping member having a mounting slot defined on a back side thereof for detachably mounting the clamping member on a jaw of the standard bar clamp and a pressure pad on the upper end and frontal side of the clamping member. A pair of laterally spaced mounting flanges are formed on a lower end of the clamping member to define a mounting slot. A pair of upper and lower bearing and guide rollers are preferably mounted in the slot for slidably mounting the clamping member on a slide bar of the standard bar clamp to convert the bar clamp to a deep jaw bar clamp.

11 Claims, 2 Drawing Sheets

10
11
11'
12
13
14
15
16
17
18
19
20
21
22
23
24
25
26
27
28
29
31
32
33
34
35
36
a
W
II

CLAMP JAW EXTENDER FOR BAR CLAMPS

This application relates to an extender adapted for releasable attachment to each jaw of a standard bar clamp to convert the bar clamp to a deep jaw bar clamp.

BACKGROUND ART

Pipe and bar clamps are widely used by cabinet makers and others for the purpose of clamping a workpiece or pieces together to facilitate a particular work application. For example, U.S. Pat. No. 5,064,178 discloses a conventional pipe clamp of this type, comprising an elongated pipe or beam, a tail-stop clamp assembly adapted to be selectively locked in place thereon, and a head clamp assembly also slidably mounted on the pipe for axial movement relative to the tail stop assembly. The workpiece or pieces are adapted to be clamped between opposed jaws of the tail stop and head clamp assemblies in a conventional manner.

Applicant's U.S. Pat. No. 4,921,234 discloses extenders adapted to be detachably mounted on the jaws of a standard pipe or beam clamp to substantially increase clamping depth to eight or more inches. The extenders are adapted to fit most popular three-quarter inch pipe clamps, such as the well-known Pony®, Brink & Cotton®, Hargrave®, Craftsman®, and others. The extenders are adapted to slip on and off the clamp jaws of the standard pipe clamp in seconds, and substantially increase the cost effectiveness of multiple deep-clamping applications. Further, the extenders are adapted to work over, under and through other clamps for greater project versatility.

Extenders for the pipe clamp are mounted on the clamp jaws, after the clamp jaws have been removed from the pipe. The clamp jaws with the extenders are then remounted on the pipe. However, since the clamp jaws used in standard bar clamps cannot be removed from the bar on which they are mounted, applicant was confronted with the problem of providing extenders therefor without having to modify the standard bar clamp.

DISCLOSURE OF INVENTION

This invention provides an improved clamp jaw extender for a standard bar clamp that further increases the overall versatility of work applications for the type of extender disclosed in applicant's U.S. Pat. No. 4,921,234, particularly for the assembly and construction of wood cabinets and other specialized carpentry-type products. The clamp jaw extender comprises an elongated clamping member and mounting means on the back side of the clamping member for detachably mounting the clamping member on a jaw of a standard bar clamp. A pressure pad is provided on the upper end and frontal side of the clamping member for engaging, clamping and holding a workpiece or pieces together with the pressure pad of a second, opposed clamp jaw extender.

In one aspect of this invention, a pair of laterally spaced mounting flanges on the lower end of the clamping member defines a mounting slot adapted to receive a slide bar of the standard bar clamp therein.

In another aspect of this invention, upper and lower bearing and guide means, secured between the mounting flanges, define a closed channel in the mounting slot for receiving and closely capturing the slide bar of the standard bar clamp therein. The upper and lower bearing and guide means are positioned in sliding bearing contact with upper and lower rail surfaces of the slide bar, respectively, whereby tipping and clamping forces applied to a workpiece are closely controlled in a uniform manner.

In another aspect of this invention, a method is taught for mounting the clamp jaw extender on a slide bar of a standard bar clamp.

BRIEF DESCRIPTION OF THE DRAWINGS

Other advantages and objects of this invention will become apparent from the following description and accompanying drawings, wherein.

BEST MODE FOR CARRYING OUT THE INVENTION

Figures 1, 4:
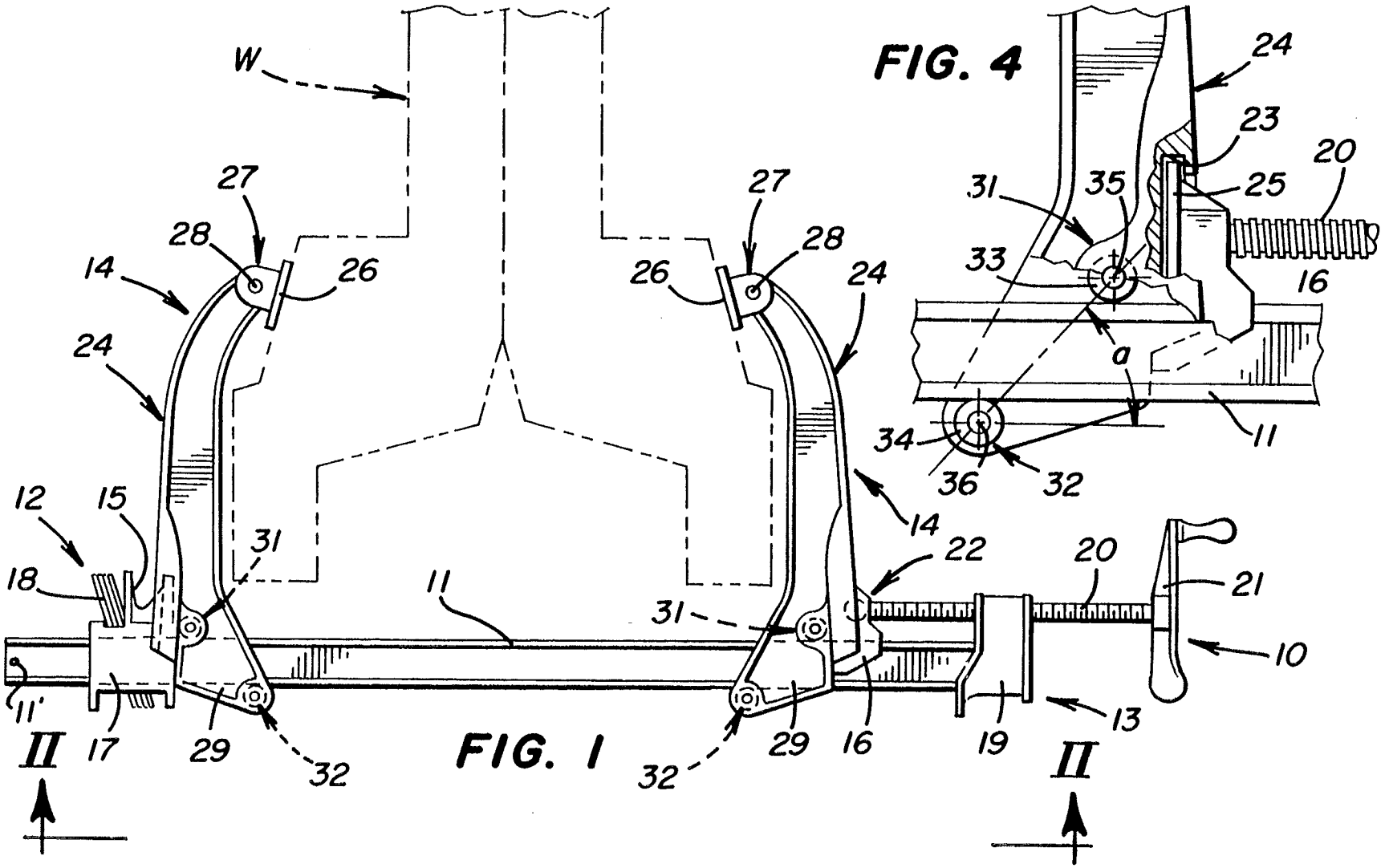
FIG. 1 is a side elevational view illustrating a pair of clamp jaw extenders of this invention mounted on the clamp jaws of a standard bar clamp to convert the bar clamp to a deep draw bar clamp.
FIG. 4 is an enlarged and partially sectioned side elevational view illustrating the mounting of a clamp jaw extender on a clamp jaw at the head clamp assembly end of the standard bar clamp; and, FIG. 5 is an exploded, isometric view illustrating a slotted connection at the backside of a clamp jaw extender for mounting the extender to its FIG. 4 assembled position on the clamp jaw.

FIG. 1 illustrates a standard bar clamp 10 comprising an elongated slide bar 11 having a tail stop assembly 12 and a head clamp assembly 13 mounted thereon in a conventional manner. A cross pin 11' is secured to the tail end of the slide bar to provide a stop, preventing removal of the tail stop assembly from the slide bar. As described more fully hereinafter, identical clamp jaw extenders 14 of this invention are detachably mounted on clamp jaws 15 and 16 of the tail-stop and head clamp assemblies of the bar clamp in much the same manner as described in U.S. Pat. No. 4,921,234. A workpiece or pieces W, shown in phantom lines in FIG. 1, are adapted to be clamped between extenders 14 to carry forth a particular work task.

Tail-stop clamp assembly 12 of the standard bar clamp further comprises a slide block 17 and a plurality of stacked cam plates 18, slidably mounted on slide bar 11. The cam plates function in a conventional manner whereby when pressure is applied to the cam plates in a leftward direction in FIG. 1 by tail clamp jaw 15, the plates will tilt and frictionally engage that slide bar to hold jaw 15 and attached clamp jaw extender 14 in a set and locked position. Conventional head clamp assembly 13 comprises a fixed block 19 secured to an end of slide bar 11 and an elongated screw 20 threadably mounted in the fixed block.

An outboard end of the screw had a handle 21 secured thereon, whereas the inboard or opposite end of the screw is connected to head clamp jaw 16 at a standard ball and socket connection 22. Thus, with the tail-stop clamp assembly suitably locked in place and with workpiece or pieces W suitably positioned between clamp jaw extenders 14, a turning-down of screw 20 by handle 21 will firmly grip the workpieces between the clamp jaw extenders. Both extenders are slidably mounted on slide bar 11, as described more fully hereinafter.

Figure 5:
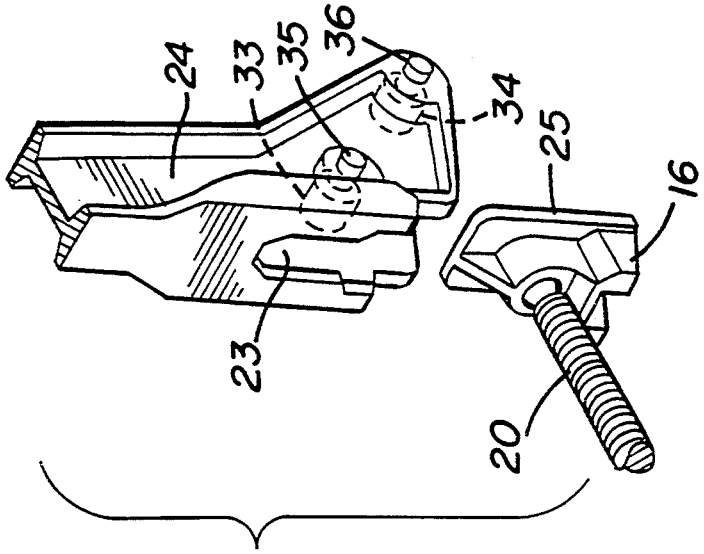
Figure 3:
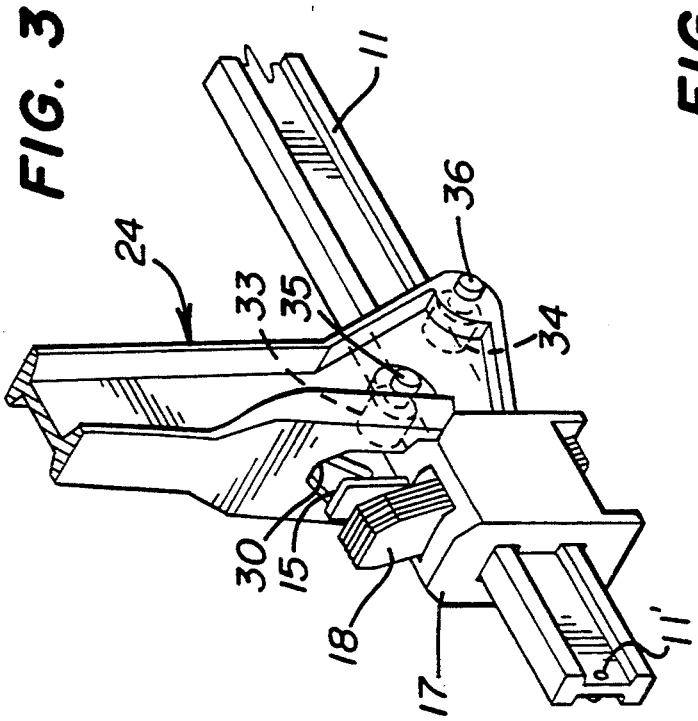
FIG. 3 is a partial view illustrating the mounting of a clamp jaw extender on a clamp jaw at the tail-stop clamp assembly end of the standard bar clamp.
Figure 2:
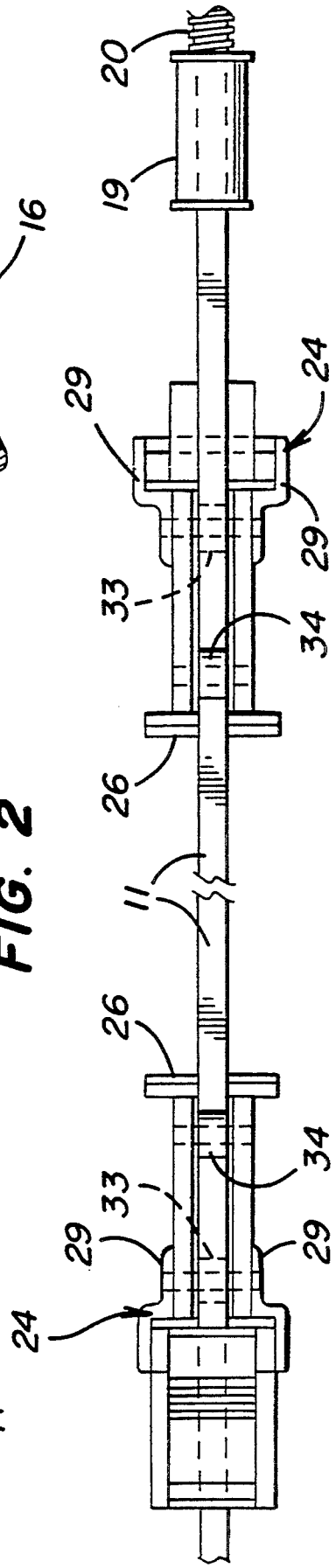
FIG. 2 is a bottom plan view of the clamp jaw extender and standard bar clamp combination illustrated in FIG. 1, and taken in the direction of arrows II—II therein.

Briefly referring to FIGS. 4 and 5, a mounting slot 23 is defined on a backside of each clamping member 24. The slot is sized for receiving a mounting flange 25, secured on a respective jaw 15 or 16 to provide mounting means for detachably mounting the respective clamping member thereon. This slotted mounting arrangement is the same general type as described in U.S. Pat. No. 4,921,234.

Referring again to FIG. 1, a pressure pad 26 is disposed at an upper end and frontal side of each clamping member 24 for engaging, clamping and holding workpieces W, along with the pressure pad of the second, opposed clamp jaw extender. Although the pressure pad could be fixed to the clamping member, the pressure pad is preferably secured on the frontal side of a swivel foot 27. The swivel foot is pivotally mounted on the upper end of the clamping member by a transversely disposed pin 28.

As shown in FIGS. 1–4, a pair of laterally disposed mounting flanges 29 are integrally formed on the lower end of clamping member 24. The flanges define a mounting slot 30, adapted to receive and straddle slide bar 11 in closely fitted relationship. As more clearly shown in FIG. 4, upper and lower bearing and guide means 31 and 32, respectively, are secured between the mounting flanges and spaced apart vertically and horizontally.

The guide means thus define a closed channel in the mounting slot for receiving and closely capturing slide bar 11 therein. The upper and lower bearing and guide means are positioned for sliding bearing contact with upper and lower rail surfaces of the slide bar, respectively. As a result, closely controlled application of pressure to the workpieces can be accomplished.

In the preferred embodiment of this invention, means 31 and 32 comprise rollers 33 and 34 in the form of bearing bushings rotatably mounted on axle pins or bolts 35 and 36, respectively. Preferably, lower roller 34 is positioned forwardly of upper roller 33, relative to the frontal side of clamping member 24. Further, the rotational axes of the rollers are disposed in parallel relationship relative to each other.

As shown in FIG. 4, an imaginary line intersecting the rotational axes of the rollers is preferably disposed at an angle "a" selected from within the approximate range of from 30° to 60° relative to an imaginary horizontal plane containing slide bar 11. The clamp jaw extender is shown in its normal, vertically disposed position generally perpendicular to the slide bar. As shown in FIG. 1, a leading face of pressure pad 26 is preferably positioned slightly forwardly of the rotational axis of lower roller 34, relative to the frontal side of clamping member 24, and is positioned substantially forwardly of upper roller 33.

In assembling the clamp jaw extenders on the standard bar clamp, lower bolts 36 and rollers 34 (FIG. 4) are removed from the lower end of each member 24 to expose slot 23. The clamping members are then inserted over slide bar 11 and on mounting flanges 25 and 29 at mounting slots 23 and 30, respectively. Thereafter, bolts 36 and rollers 34 are reattached to the clamping members to "capture" the slide bar within the closed channels defined between mounting flanges 29.

Thus, clamp jaw extenders 14 are slidably mounted on the slide bar and positioned thereon to receive workpieces W between the extenders. Handle 21 can be turned clockwise to apply clamping pressure to the workpieces at pressure pads 26 of the extenders. Mounting flanges 25, 29 and mounting slots 23, 30 are suitably sized to prevent the clamp jaw extenders from becoming detached from their respective clamp jaws 16, 17.

It should be noted in FIG. 1 that the extender mounted on tail-stop clamp assembly 12 will tend to tilt counter-clockwise to maintain bearing contact between the extender's rollers 35 and 36 and the upper and lower rail surfaces of slide bar 11, respectively. Simultaneously therewith, clamping pressure imposed on the pressure pad of the extender mounted on head clamp jaw 16 will tend to rock its attached clamping member 24 clockwise to absorb forces at its rollers 33 and 34, also engaging the upper and lower rail surfaces of the slide bar in bearing contact.

Thus, the rollers of the two clamp jaw extenders will function to uniformly and efficiently absorb clamping forces and impart them directly to slide bar 11. Clamping members 24 may be composed of any suitable material, such as a high strength aluminum alloy, steel, or a high strength composite plastic material. Rollers 33 and 34 are preferably composed of a hardened steel material normally utilized for load bearing applications of this type.

From the above description, it can be appreciated that the roller guides on slide bar 11 transmit the leverage load developed by extending the clamp jaws directly to the bar. Standard clamp jaws 15, 16 experience the same load condition as though the load were between the standard clamp jaws as normal. Thus, the standard clamp is not over-stressed under normal application.

This condition is different than the clamping function provided by the claim disclosed in U.S. Pat. No. 4,921,234. In particular, the hardened rollers 33, 34 allow clamping members 24 to move freely along the bar under load and allow the clamping load to be transmitted from the workpiece to the standard clamp with minimal increase in load at the standard clamp.

I claim:

1. A clamp jaw extender for use with a second identical and opposed clamp jaw extender, each extender adapted for releasable attachment to each respective jaw of a standard bar clamp to convert said standard bar clamp to a deep jaw bar clamp, said clamp jaw extender comprising an elongated clamping member having upper and lower ends and frontal and back sides, mounting means on the back side of said clamping member for detachably mounting said clamping member on a jaw of said standard bar clamp, pressure pad means on the upper end and frontal side of said clamping member for engaging, clamping and holding a workpiece, and a pair of laterally spaced mounting flanges on the lower end of said clamping member defining a mounting slot adapted to receive a slide bar of said standard bar clamp in closely fitted relationship therein.

2. The clamp jaw extender of claim 1 further comprising upper and lower bearing and guide means secured between said mounting flanges and spaced apart vertically to define a closed channel in said mounting slot for receiving and closely capturing said slide bar therein, said upper and lower bearing and guide means being positioned for sliding bearing contact with upper and lower rail surfaces of said slide bar, respectively.

3. The clamp jaw extender of claim 2 wherein said lower bearing and guide means is positioned forwardly of said upper bearing and guide means, relative to the frontal side of said clamping member.

4. The clamp jaw extender of claim 3 wherein each of said upper and lower bearing and guide means comprises a roller rotatably mounted between said mounting flanges and wherein rotational axes of the rollers of said upper and lower bearing and guide means are disposed in parallel relationship relative to each other.

5. The clamp jaw extender of claim 4 wherein an imaginary line intersecting the rotational axes of the rollers of said upper and lower bearing means is disposed at an angle within the approximate range of from 30° to 60° relative to an imaginary horizontal plane when said clamp jaw extender is in a vertically disposed position.

6. The clamp jaw extender of claim 5 wherein said angle approximates 45°.

7. A clamp jaw extender and standard bar clamp combination comprising:

a first and second elongated clamping member having upper and lower ends and frontal and back sides, mounting means on the back side of each said clamping member for detachably mounting each said clamping member on a jaw of said standard bar clamp, pressure pad means on the upper end and frontal side of each said clamping member for engaging, clamping and holding a workpiece, a pair of laterally spaced mounting flanges on the lower end of each said clamping member defining a mounting slot adapted to receive a slide bar of said standard bar clamp in closely fitted relationship therein, and an elongated slide bar having a tail-stop assembly slidably mounted on said slide bar including a first jaw and a head clamp assembly slidably mounted on said slide bar including a second jaw axially disposed in face-to-face relationship relative to said first jaw, wherein each said clamp jaw extender is detachably mounted on each of said first and second jaws by its respective mounting means.

8. The clamp jaw extender and bar clamp combination of claim 7 wherein said clamp jaw extender is at least generally disposed in perpendicular relationship relative to said slide bar when said upper and lower bearing and guide means are maintained in sliding bearing contact with the upper and lower rail surfaces of said slide bar, respectively.

9. The combination of claim 8 wherein a leading face of said pressure pad means is positioned forwardly of said upper bearing and guide means, relative to the frontal side of said clamping member.

10. The combination of claim 9 wherein the leading face of said pressure pad means is positioned forwardly of said lower bearing and guide means and said lower bearing and guide means is positioned forwardly of said upper bearing and guide means, relative to the frontal side of said clamping member.

11. The combination of claim 9 wherein the lower bearing and guide means is disposed forwardly of said upper bearing and guide means, relative to the frontal side of said clamping member.

* * * * *